United States Patent [19]

Hilts et al.

[11] Patent Number: 4,524,833

[45] Date of Patent: Jun. 25, 1985

[54] APPARATUS AND METHODS FOR ORIENTING DEVICES IN SIDE POCKET MANDRELS

[75] Inventors: Robert L. Hilts, Farmers Branch; Robert W. Crow, Irving, both of Tex.

[73] Assignee: Otis Engineering Corporation, Dallas, Tex.

[21] Appl. No.: 535,214

[22] Filed: Sep. 23, 1983

[51] Int. Cl.[3] ..... E21B 23/03

[52] U.S. Cl. ..... 166/381; 166/117.5

[58] Field of Search ..... 166/117.5, 117.6, 384, 166/381, 386, 378, 380; 175/451; 417/109; 285/24, 27, 93, 349

[56] References Cited

U.S. PATENT DOCUMENTS

| | | | |
|---|---|---|---|
| 2,900,028 | 8/1959 | Hames | 285/349 |
| 3,101,984 | 8/1963 | Wieckmann | 285/DIG. 19 |
| 3,139,293 | 6/1964 | Franck | 285/93 |
| 3,149,861 | 9/1964 | Larsson | 285/349 |
| 3,827,489 | 8/1974 | McGowen, Jr. | 166/117.5 |
| 3,827,490 | 8/1974 | Moore, Jr. et al. | 166/117.5 |
| 3,837,398 | 9/1974 | Yonker | 166/117.5 |
| 4,002,203 | 1/1977 | Terral | 166/117.5 |
| 4,106,563 | 8/1978 | Gatlin et al. | 166/117.5 |
| 4,294,313 | 10/1981 | Schwegman | 166/117.5 |
| 4,411,314 | 10/1983 | Shearhart | 166/124 |
| 4,432,416 | 2/1984 | Welch et al. | 166/117.5 |
| 4,438,810 | 3/1984 | Wilkinson | 175/451 |
| 4,440,222 | 4/1984 | Pullin | 166/117.5 |

FOREIGN PATENT DOCUMENTS

| | | |
|---|---|---|
| 1515248 | 6/1978 | United Kingdom . |
| 1515249 | 6/1978 | United Kingdom . |
| 2115455 | 9/1983 | United Kingdom . |

*Primary Examiner*—James A. Leppink
*Assistant Examiner*—Hoang C. Dang
*Attorney, Agent, or Firm*—Albert W. Carroll

[57] ABSTRACT

Apparatus and methods for installing a well tool device in the offset receptacle of a side pocket mandrel in predetermined oriented relation therein.

24 Claims, 12 Drawing Figures

APPARATUS AND METHODS FOR ORIENTING DEVICES IN SIDE POCKET MANDRELS

BACKGROUND OF THE INVENTION

1. Field of the Invention

This invention relates to well tools and, more particularly to apparatus and methods for installing well tool devices in offset receptacles of side pocket mandrels in predetermined oriented relation therewith.

2. Description of the Prior Art

It has been common practice for many years to equip wells for the practice of gas lift techniques to enable gas to be injected into the well to enhance production where formation pressures are insufficient to provide acceptable production. It is common practice to equip gas lift wells with side pocket mandrels and to use kickover tools to install gas lift valves or other well tool devices in or to remove them from the offset receptacle bores of the side pocket mandrels. Many wells, especially deep or deviated wells, have been equipped with orienting type side pocket mandrels, each having an orienting sleeve therein. Orienting type kickover tools has been used with such orienting side pocket mandrels, such orienting kickover tools, each having an orienting key for engaging the orienting sleeve of an orienting type side pocket mandrel to orient the kickover tool about its longitudinal axis to align its orienting key with the mandrel's orienting slot so that, upon activation of the kickover tool, the gas lift valve or other well tool device carried by the kickover tool will be position above and in axial alignment with the offset receptacle bore. Thus, orienting side pocket mandrels and orienting kickover tools are well known in the gas lift art.

Orienting kickover tools for use in pumpdown wells are shown at least in U.S. Pat. No. 4,294,313 which issued Oct. 13, 1981 to Harry E. Eschwegman. Orienting kickover tools for use with wire line are shown in U.S. Pat. No. 3,827,489 which issued Aug. 6, 1974 to Harold E. McGowen, Jr., U.S. Pat. No. 3,827,490 which issued Aug. 6, 1974 to Howard H. More, et al., and U.S. Pat. No. 3,876,001 which issued Apr. 8, 1975 to William B. Goode. All of the just-mentioned patents show orienting type mandrels. Further, U.S. Pat. No. 4,333,527 which issued June 8, 1982 to Robert S. Higgins and David T. Merritt, shows orienting side pocket mandrels of both the pumpdown and the wireline type.

U.S. Pat. Nos. 3,827,489; 3,827,490; 3,876,001; 4,294,313; and 4,333,527 are incorporated herein, by reference thereto, for all purposes.

Applicants are not aware of any prior art which teaches installing a device in the offset receptacle of a side pocket mandrel in a specific predetermined oriented relation therewith.

SUMMARY OF THE INVENTION

The present invention is directed toward apparatus and methods for orienting devices in the offset receptacles of side pocket mandrels, such apparatus utilizing a side pocket mandrel with orienting sleeve means therein; a kickover tool having orienting key means theron cooperable with the orienting sleeve means in the mandrel to orient the kickover tool with respect to the offset receptacle in the side pocket mandrel, the kickover tool having well tool carrying means thereon; a well tool device carried by the well tool carrying means of the kickover tool; and means for holding the well tool device in predetermined orientation with respect to the kickover tool.

Therefore one object of this invention is to provide apparatus for installing a device in the offset receptacle of a side pocket mandrel in predetermined relations therewith.

Another object is to provide apparatus such as that described which include an orienting type kickover tool having means thereon for carrying a well tool device in predetermined oriented relation therewith.

Another object is to provide such apparatus wherein the means for orienting the well tool device relative to the kickover tool is adjustable.

A further object is to provide such adjustable orienting means which includes friction gripping means for holding the well tool device against rotating about its longitudinal axis during its downward trip into a well.

Another object it is to provide adjustable means for orienting a well tool device relative to a running tool carried by a kickover tool, such adjustable means being in the form of indexing means.

Another object is to provide such indexing means constituting a plurality of apposed circumferentially spaced recesses on the running tool and on the well tool device and having a key or pin engaged in an aligned pair of these opposed recesses to prevent relative rotation of said device with respect to the running tool, the number of recesses on the running tool being in many cases unequal to the number of recesses on the device.

Another object is to provide indexing means such as that just described wherein the unequal number of recesses on the running tool and on the device provides a number of orienting positions equal to the number of recesses on the running tool multiplied by the number of recesses on the device.

Another object of this invention is to provide a side pocket mandrel having an offset receptacle bore in which a well tool device can be installed in predetermined oriented relation, the mandrel having a lateral window in the wall of the receptacle bore.

Another object is to provide apparatus for passing sound waves between the tubing and the tubing-casing annulus of a well, such apparatus including a side pocket mandrel, a kickover tool, and well tool device together with means for orienting the well tool device relative to the kickover tool and for orienting the kickover tool relative to the side pocket mandrel to assure that the device will be anchored in the side pocket mandrel in predetermined oriented position therein.

Another object of this invention is to provide methods of installing a well tool device in the offset receptacle of a side pocket mandrel in predetermined oriented relation therein.

A further object is to provide methods of installing a well tool device having a lateral window in its wall in the offset receptacle of a side pocket mandrel also having a lateral window in its wall so that the window of the device is in substantial register with the window of the mandrel.

Another object is to provide means on a kickover tool and on a well tool device which are coengageable to orient said device with respect to said kickover tool.

Another object is to provide an improved running tool for kickover tools, said running tool having means engageable with a well tool device for holding said device in predetermined oriented position relative to said kickover tool.

Other objects and advantages will become apparent from reading the description which follows and from studying the accompanying drawing, wherein:

DESCRIPTION OF THE PREFERRED EMBODIMENTS

Figure 1:
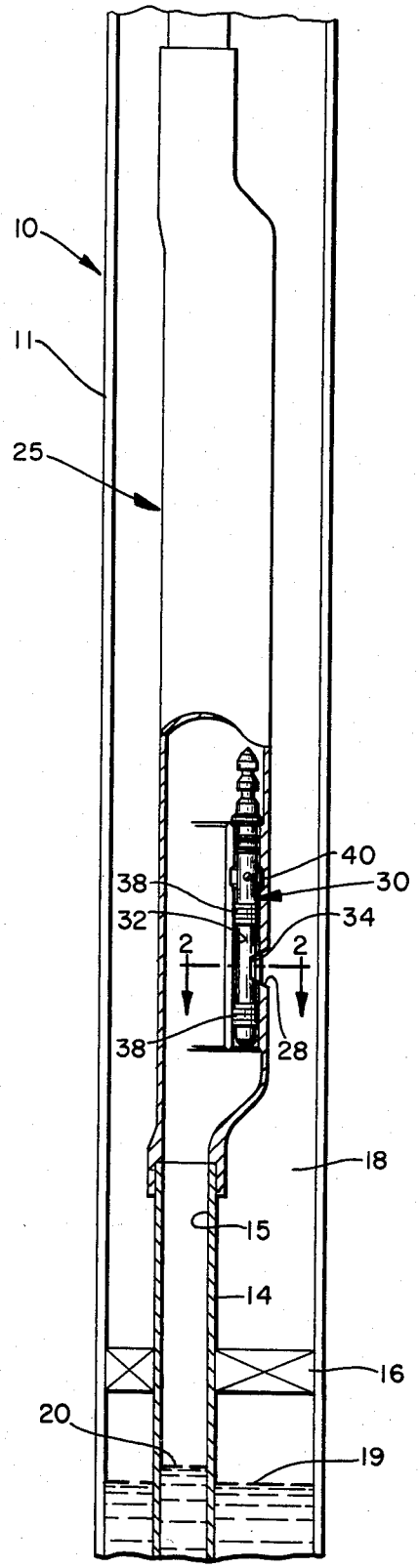
FIG. 1 is a schematical view of an intermediate portion of a well showing a side pocket mandrel with a tool device disposed therein in predetermined relation.
Figure 2:
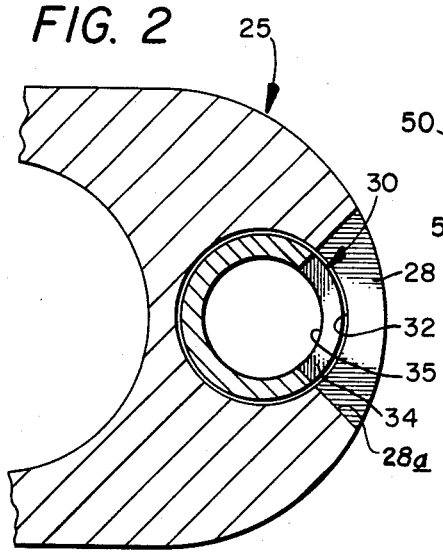
FIG. 2 is an enlarged fragmentary cross-sectional view taken along line 2—2 of FIG. 1.
Figure 3:
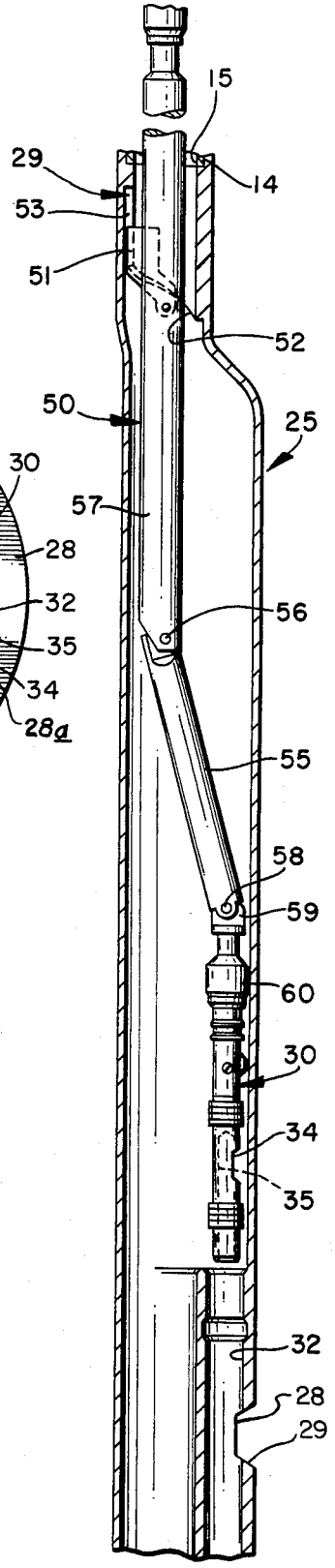
FIG. 3 is an enlarged fragmentary showing the well tool device of FIG. 1 being installed in the side pocket mandrel of FIG. 1.

Referring now to FIGS. 1–3 of the drawing, is seen that a well 10 is provided with a well casing 11. A well tubing string 14 having a bore 15 is disposed within the casing 11 and a well packer 16 seals the annulus 18 between the tubing and casing at a location above a producing formation (not shown).

Production fluids from the producing formation enter the well casing in the well-known manner, such as through conventional casing perforations (not shown). Production fluids rise in the well, but only to a limited height because the formation pressure is insufficient to force them higher. In well 10, the liquid level is shown to be at 19 in the annulus below the packer and at 20 in the tubing.

It may be desired periodically, perhaps even daily, or more often, to determine the location of the liquid level in the tubing and for some reason it is not feasible to do this by means movable through the tubing of well 10. It may be that the tubing bore may be blocked or severely restricted by means not shown so that liquid levels cannot be determined by means movable through the tubing bore.

It is well known to determine the location of the liquid level in a well by directing sound waves, normally created by firing a blank cartridge, downward from the surface and then receiving the echo which bounces off the surface of the liquid downhole. The sound waves are generally recorded on a strip chart and not only can the liquid level be determined but also identifiable are recordings representing pipe collars and other objects presenting a shoulder or surface from which the sound waves can be reflected. Sound waves may be directed down either the tubing or the casing to locate their respective liquid levels.

In the well 10, illustrated in FIG. 1, the sound waves must be directed down the tubing-casing annulus 18 while the liquid level to be determined is in the tubing. This determination is accomplished in a manner which will now be described.

The tubing string 14 is equipped with a side pocket mandrel 25 which possesses the structure of a common orienting type side pocket mandrel as taught in U.S. Pat. No. 4,333,527, for example with the exception that it is provided with a lateral window 28 in its wall, as shown, rather than being provided with the usual flow ports. Mandrel 25 is shown in FIG. 3 to be provided with an orienting means 29 nears its upper end as taught in U.S. Pat. Nos. 4,333,527; 3,827,489; and 3,827,490, and is, therefore, of the wireline type and valves or other devices, such as well tool device 30, are installed in and removed from the offset receptacle 32 of the mandrel though use of tools such as the kickover tool taught in U.S. Pat. No. 3,876,001 run into and out of the tubing via well-known wireline.

The lateral window 28 of the mandrel is preferably as large as it is practical to make it and may be of any suitable shape, such as rectangular, square, round, or similar shape. Whatever the shape, the walls of the window may preferably be flared outwardly with straight, plane, or curved surfaces to provide a guide-in for sound waves entering the receptacle bore from the well annulus. Window 28 is shown to have beveled sides as at 28*a*. The area of the window opening is preferably equal to at least one-tenth the cross sectional area of the receptacle bore 32, and it may be as large as 10 times the cross sectional area of the receptacle bore.

A side pocket mandrel (now shown herein, but taught in U.S. Pat. Nos. 4,294,313 and 4,333,527) of the pumpdown type having the orienting sleeve below the offset receptacle could be used in the stead of the wireline side pocket mandrel 25, in equipping pumpdown wells for operations such as those described herein. Kickover tools for use with pumpdown mandrels are taught in U.S. Pat. Nos. 4,294,313 and 4,333,527.

Either of these mandrels, as well as the device 30 may be obtained from Otis Engineering Corporation, Dallas, Tex.

In FIG. 3, device 30 is shown to have a downward opening bore 35 and the lateral window 34 located between upper and lower seals 38, communicates bore 35 with the exterior of the device 30. Lateral window 34 should be shaped and flared to resemble window 28 of the mandrel 25.

In FIG. 1, the device 30 is shown positioned in receptacle 32 of mandrel 25. Device 30 has its seals 38 sealingly engaging the receptacle above and below mandrel window 28. The window 34 of the device 30 is in substantial register with window 28 of the mandrel as is clearly seen in both FIGS. 1 and 2.

The device 30 is installed in the offset receptacle 32 of the side pocket mandrel and is locked in place therein by engagement of its latch 40 in the locking recess 42. Latch 40 may be of any suitable design so long as it is compatible with the offset receptacle in which it is to be installed.

Device 30 is installed in the offset receptacle 32 of the side pocket mandrel 25 in predetermined oriented relation therewith so that their windows 28 and 34 will be in substantial register as shown. With windows 28 and 34 of the mandrel 25 and device 30 in substantial register, as seen in FIG. 1, sound waves are directed from the surface downward in the well annulus. These sound waves, upon reaching window 28 of the mandrel 25, enter therein and pass through aligned window 34 of device 30, travel downward through bore 35, and emerge from the lower open end of device 30. The sound waves then move downward through the lower end of the mandrel and travel down the tubing bore 15 until they encounter the liquid level 20 and are reflected or echoed back toward the surface. The sound echo retraces the same path just traveled by the sound waves from the surface to the liquid level 20 in the tubing. Thus, the reflected sound waves move upward through the tubing bore 15 to the side pocket mandrel where they enter the lower open end of the device 30, travel though its bore 35, pass laterally outward through the registered windows 34 and 28 and into the annulus 18, through which they then travel to the surface. At the surface, these sound waves are recorded by a strip chart recorder, or the like, not shown. The strip chart recording will be read and interpreted to determine the location of the liquid level in the tubing.

It is readily seen that determination of the liquid level in the tubing by sending sound waves down the annulus outside the tubing is made possible by accurately placing the windows 28 and 34 of the mandrel 25 and device 30 in register as just described. The apparatus and methods for orienting the device 30 in the offset receptacle 32 so as to place their windows 34 and 28 in registry will now be described.

It is well known that an orienting kickover tool will orient in a side pocket mandrel and will, upon activation, shift a well tool such as a gas lift valve or device 30 laterally to a position just above and in axial alignment with the offset receptacle. This is because a kickover tool, for instance kickover tool 50 of FIG. 3, is provided with an outwardly projecting orienting key 51 which upon upward travel in the mandrel engages the guide surface 52 of orienting means 29. The key 51, then follows the guide surface 52 and causes the kickover tool to be rotated about its longitudinal axis until the key becomes aligned with and enters the orienting slot 53. When key 51 is in slot 53, the well tool device, such as device 30, carried by the kickover tool is on the side of the kickover tool facing the offset receptacle of the mandrel. Only slight upward movement of the kickover tool in the mandrel is then needed to activate the kickover tool and cause it to shift the device carried thereby laterally to a position just above and ready to be lowered into the receptacle. This is seen in FIG. 3. Then, as the kickover tool is lowered, the device enters the offset receptacle and is installed therein in the well-known manner.

The kickover tool 50, as was before stated, will always orient the same way in the side pocket mandrel, that is with the orienting key in the orienting slot and therefore with the well tool device facing the offset receptacle. In order to assure that the window of a device such as device 30 will be registered with the window of the side pocket mandrel, it is necessary to first orient the device with respect to the kickover tool prior to lowering the kickover tool into the well. This may be accomplished in a variety of ways, only a few of which will now be described.

First, it will be seen in FIG. 3 that the kickover tool 50 is provided with a pivot arm 55 having its upper end pivotally attached as at 56 to the housing 57 while its lower end is pivotally attached as at 58 to tool carrier means 59 which may include a suitable running tool such as running tool 60. Of course, for removing a device from the offset receptacle, the running tool 60 would be replaced by a suitable pulling tool (not shown), several of which are well known in the industry. It is important to note that the connections at 56 and 58 at opposite ends of the pivot arm are hinge-type connections and will not swivel, but will pivot only in a single plane as shown.

Since the orienting sleeve may be secured in a side pocket mandrel with its orienting slot located at any point about the longitudinal axis thereof, and since the window in the wall of the side pocket mandrel, as well as the window in the wall of the well tool device which is to be installed in the offset receptacle of the mandrel in proper oriented position so that the two windows will be in register, the orientation of the well tool device with respect to the orienting key of the kickover tool in which the device is carried must agree with the orientation of the orienting slot of the orienting sleeve of the side pocket mandrel in relation to the receptacle bore.

Figure 4:
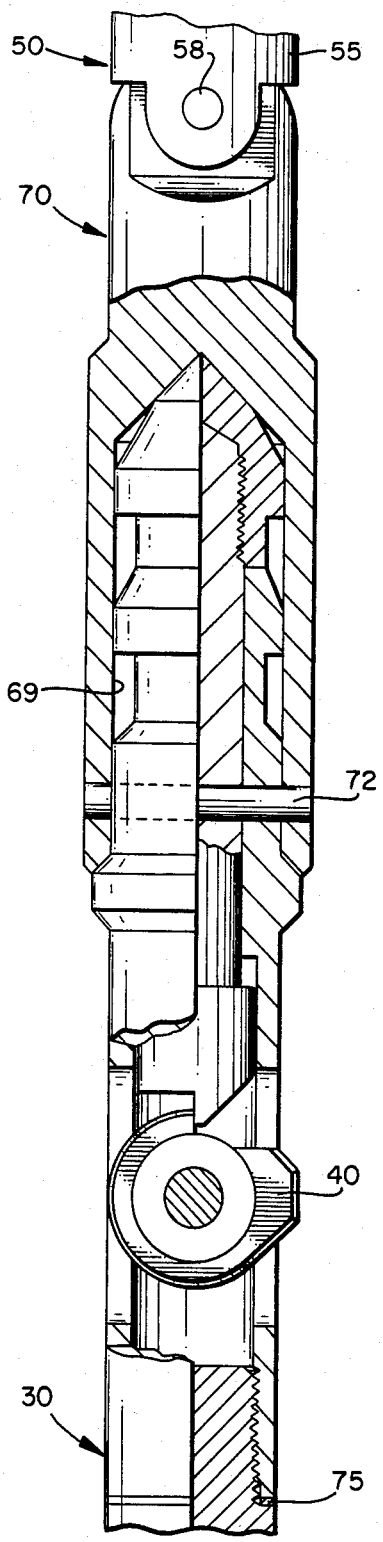
FIG. 4 is a fragmentary view, partly in longitudinal section and partly in elevation with some parts broken away, showing a well tool attached to the tool carrier of a kickover tool.

Orienting side pocket mandrels are generally made so that the orienting slot in the orienting means is positioned 180 degrees about the mandrel's longitudinal axis from the offset receptacle and are so illustrated herein. Therefore, it is important in such case to attach the device 30 to the kickover tool so that the window of the device faces in the opposite direction from the orienting key. Then, the device must be kept from rotating about its longitudinal axis during its downward trip into the well. FIG. 4 shows a simple, but not the most desireable way, of doing this.

In FIG. 4, it will be seen that a device 30 is attached to a kickover tool 50. The device 30 has its upper end portion telescoped into the downward opening bore 69 of the tool carrier 70. After the device was telescoped into the carrier and rotated to its oriented position, a hole was drilled through both of them and a shear pin 72 was installed as shown. Thus, the shear pin 72 will not only maintain the device securely attached to the kickover tool but will also prevent is rotating from is predetermined oriented position. Thus, when the device is installed in the offset receptacle of a side pocket mandrel, it will be installed in the proper predetermined oriented position with its window in registry with the window of the mandrel.

While the shear pin 72 will work satisfactorily as shown, the same device 30 may not be so perfectly alignable again after it has been redressed. It may then be necessary to drill a new hole for the shear pin 72 or to use a spacer, such as the spacer 75, in one of the threaded connections somewhere in the device 30 but above the window 34. A spacer 75 of proper thickness will cause the window of the device to face the proper direction, that is, face in a direction opposite the orienting key of the kickover tool.

If desired, a suitable set screw such as screw 77 may be engaged in a threaded aperture of the runing tool 70 and tightened against the device 30 as shown to secure the device in any selected oriented position, in which case the pin 72 need not have its ends engaged in apertures of the running tool. Understandably, such a screw could be used to lock any selected threaded connection to secure the predetermined orientation of the device to assure its proper installation in the mandrel.

Figure 5:
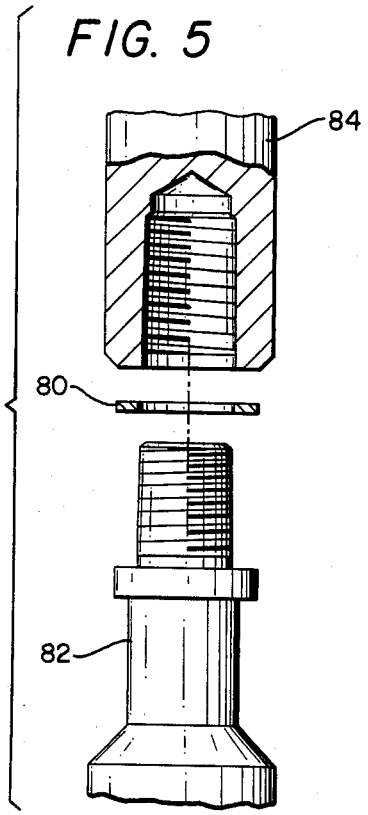
FIG. 5 is an exploded view showing a spacer ready to be placed between two threaded members which are to be screwed together.

Spacer 80 (see FIG. 5) is like or similar to spacer 75 and is placed in the threaded connection between the running tool 82 and member 84, which may be a tool carrier of a kickover tool. While tool carrier 70 was shown to be of unitary construction, it could as well be formed of two separate members, such as members 84 and 82 which are then screwed together. If needed, the spacer 80 can be placed therebetween, as just explained. It is well known to make running tools which are attached as by threads to a kickover tool or tool string.

Figure 6:
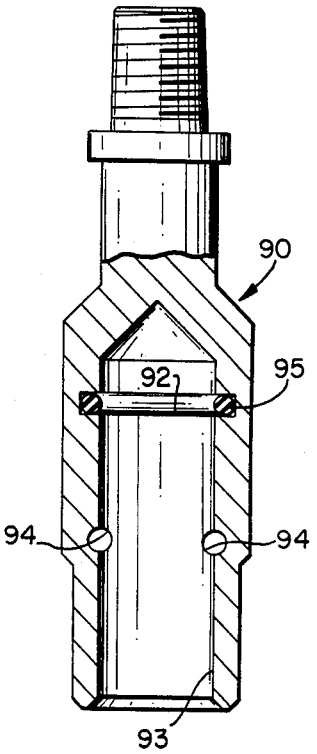
FIG. 6, is a view, partly in longitudinal section, and partly in elevation showing a running tool provided with a resilient gripping member.
Figure 7:
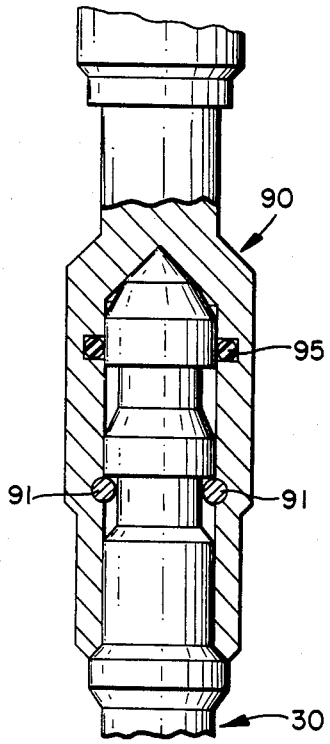
FIG. 7 is a view similar to FIG. 6 showing the running tool of FIG. 6 engaged with a well tool and with its gripping member gripping the well tool.

Referring new to FIGS. 6 and 7, it will be seen that another form of running tool 90 is illustrated. In this form of running tool, the conventional off-center or tangential shear pins 91 are used to support the device 30. Running tool 90 has been improved by forming an internal annular recess 92 in its bore 93 at a location above the shear pin holes 94. A suitable resilient gripping ring such as a common resilient o-ring 95 is disposed in the recess 92. This o-ring forms an interference fit about the upper end portion of device 30 as seen in FIG. 7 and grips it tightly. The ring 95 needs to grip the device tightly to prevent it from rotating to a non-oriented position.

To attach the device 30 to running tool 90, the device is rotated until is window 32 thereof faces 180 degrees from the orienting key on the kickover tool, the device is then pressed upwardly as far as it will go into the running tool while maintaining the window facing in the proper direction. After the device 30 has been inserted fully into the running tool, the shear pins 91 are installed. The shear pins 91 do not prevent rotation of the device 30. Therefore, it would be possible to rotate device 30 after the shear pins 91 have been installed. This would only shorten the life of the o-ring.

It is readily seen that the running tool 90 is easy to use and that it can be used to run conventional devices, such as gas lift valves, which do not need to be placed in the receptacle in a predetermined oriented relation. For such purpose, running tool 90 can be used without the resilient gripping ring 95.

When installing devices, such as the device 30, in deep and/or deviated wells the resilient gripping ring 95 in the running tool may not have sufficient gripping power and may possibly allow the device to become disoriented. This could possibly be caused by the lubricity of the well fluids diminishing the ring's gripping power or because elevated temperatures of the fluids in deep wells might physically alter the material from which the ring is made, causing the material to break down, disolve, or crack. In deviated wells, it may be possible that gravity or drag of the tools against the tubing wall could cause rotation of the device to a non-oriented position during the time that the kickover tool is slanted appreciably, and especially so if the well fluids to which it has been exposed have good lubricating qualities.

A preferred form of apparatus for installing devices such as device 30 in a predetermined oriented relation in the offset receptacle of a side pocket mandrel includes a suitable kickover tool provided with indexing means. This, of course, requires modification of the device. Such indexing mechanism including the modified device is seen in FIGS. 8–10.

Figure 8:
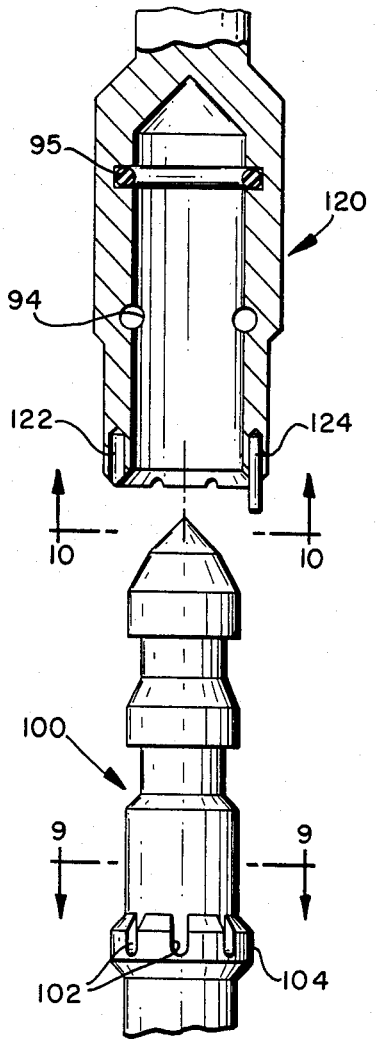
FIG. 8 is an exploded view showing a running tool ready to be attached to a well tool, the well tool and running tool being provided with indexing means.
Figure 9:
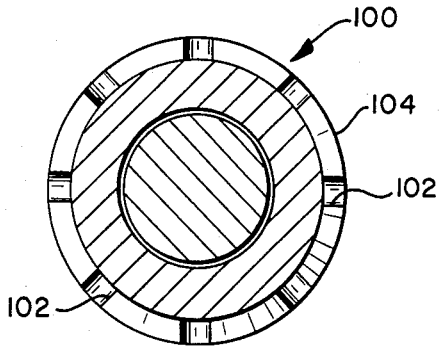
FIG. 9 is an enlarged cross-sectional view taken along line 9—9 of FIG. 8.
Figure 10:
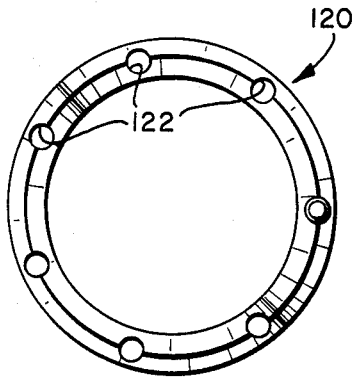
FIG. 10 is an enlarged bottom view indicated by line 10—10 of FIG. 8 showing the lower end of the running tool of FIG. 8.

Referring to FIGS. 8–10, the modified device is indicated generally by the reference numeral 100. It may be identical to device 30 previously described with the exception that a plurality of circumferentially spaced upwardly opening recesses 102 have been formed in the upper side of its no-go flange 104 as shown.

The running tool 120 may be exactly like running tool 90 previously described with the exception that a number of circumferentially space downwardly facing recesses or downwardly opening holes 122 are formed in its lower end as shown. The number of holes 122 is unequal to the number of recesses 102 formed in the device. A single key or pin 124 is received in one of the recesses or holes 122 of the running tool 120, and preferably this pin or key would fit tightly therein so that it will not be left in the well but will be withdrawn therefrom with the pulling tool. However, the key or pin is not necessarily inserted at this time.

The device 100 is rotated to the desired position and inserted into the running tool. Since the number of holes 122 in the running tool differs from the number of recesses in the device 100, one pair of recesses, that is, one hole and one recess may be substantially aligned with each other. If so, withdraw the device 100 a little, install the pin in the selected hole tightly and engage the device fully with the running tool so that the pin engages the selected recess of the device to hold the device oriented. The shear pins may then be installed in the shear pin holes 94 to securely attach the device to the running tool.

Any desired number or recesses 102 may be formed in the device 100. Whatever the number of recesses formed in the device 100, the running tool 120 may preferrably be provided with a different or unequal number of recesses 122.

For purposes of illustration the device 100 is provided with eight recesses as seen in FIG. 9 and the running tool 120 is provided with seven holes as seen in FIG. 10. This arrangement provides a multiplicity of positions equal to the number of recesses multiplied by the number of holes, or 56 positions ($8 \times 7$). This indexing means, obviously, is based upon the principle of vernier. Fifty-six positions permits the device 100 to be rotated through orienting positions which are spaced apart no more than about 6.5 degrees. This may be more readily seen by referring to FIG. 11.

Figure 11:
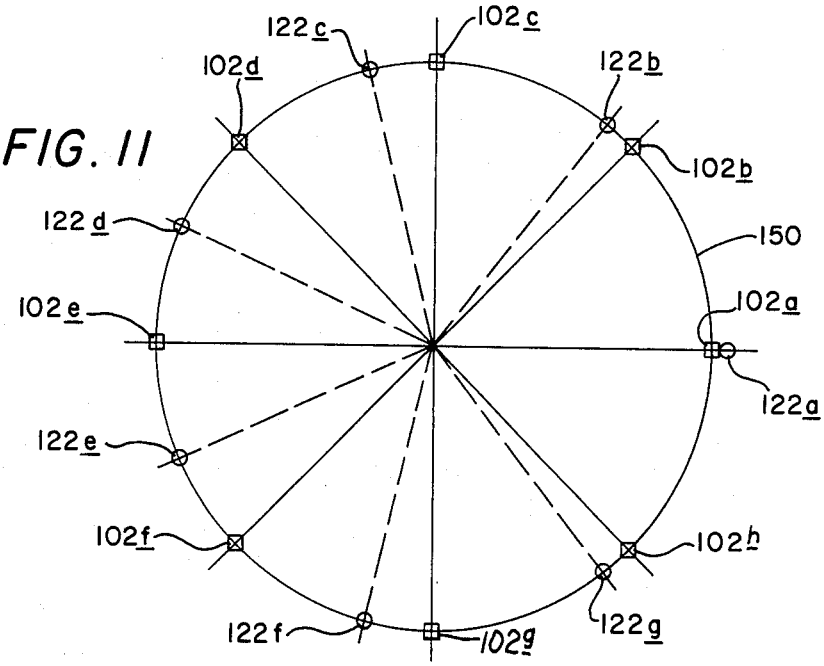
FIG. 11 is a diagram showing the vernier principle of the indexing means shown of FIG. 8.

In FIG. 11, the numeral 150 represents the circle passing through the centers of the recess 102 of the device 30. These recesses 102 are represented by small squares **102*a* through 102*h*. In similar manner, the holes 122 are represented by the small circles 122*a* through 122*g*. (To avoid confusion in the diagram of FIG. 11, the hole 122*a* was not superimposed upon the recess 102*a*** but was place closed beside it.)

Assume that the device 30 has been oriented so that its window faces approximately 180 degrees from the orienting key of the kickover tool and is then inserted into the running tool 120 and the pin 124 in hole **122*a* approximately aligns with recess 102*a*. If the pin 124 is engaged in hole 122*a* and in recess 102*a*, the relative positions of the other holes and recesses will be shown in FIG. 11. If the device 30 is not at this time satisfactorily oriented, the device 30 may be moved in either a clockwise or a counter-clockwise direction a little to bring it into a more satisfactory position. For instance, assume that the device needs to be rotated a little in a counter-clockwise direction as seen in FIG. 11. This may be accomplished by removing pin 124 and rotating the device in a counter-clockwise direction until the pin can be engaged in hole 122*b* and recess 102*b*. In so doing, the counter-clockwise rotation amounted to approximately 6.5 degrees or the amount that hole 122***b* is displaced from recess 102*b* in the diagram. In this manner, a pin/hole combination can be found which will place the device within 6.5 degrees of perfect orientation.

It is easily understood that greater accuracy or orientation could be had with an increased number of holes and recesses. For instance, if 16 recesses and 15 holes are used, than 240 stations or combinations are provided and these would be spaced at intervals of 1.5 degrees.

Alternately, a running tool similar to running tool 120 just described may be provided with a plurality of recesses or holes, such as holes 122, which are not circumferentially evenly spaced about its lower end. Such a running tool is shown in FIG. 12 where it is indicated by the numeral 150.

Figure 12:
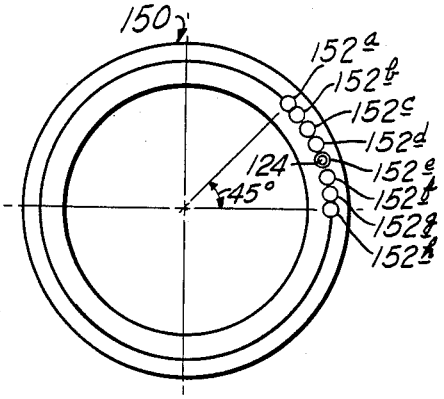
FIG. 12 is a view similar to FIG. 10 showing a modified form of running tool.

Running tool 150 is shown in FIG. 12 to be provided with a group of downwardly opening holes 152$^a$–152$^h$. The number of holes in the group may be varied as desired. In the example of FIG. 12, eight holes are shown with the end holes 152$^a$ and 152$^h$ being spaced 45 degrees apart. Thus, there are seven stations or positions provided in 45 degrees. Since pin 124, shown disposed in hole 152$^e$ can be positioned in any one of the holes 152$^a$–152$^h$ any one of the holes may be aligned with and engaged in any one of the eight recesses 102 of the latch 100 seen in FIG. 8, the number of orienting positions provided is equal to 8 times 7, or 56 positions. This is the same number of positions provided by the hole-and-recesses arrangement before explained and seen in FIGS. 8–11. It is readily understood that the running tool and/or the well tool device may be provided with any suitable number of holes or recesses and that the number of holes or recesses in one may be either equal to or unequal to the number of holes or recesses in the other.

It should be readily understood that in some cases it may be desirable to face the window of the side pocket mandrel in a direction other than that shown in FIGS. 1–3. For instance, it may be desirable to face the window toward the side in an oval mandrel such as mandrel 25 in order to space the window from the inner wall of the casing to minimize flow cutting or errosion of the casing and the mandrel by fluids flowing through the window. The window of the mandrel in other cases may even be positioned so that it communicates the receptacle bore with the main bore of the mandrel, as for waterflood operation. If the window of the mandrel faces any direction other than the direction shown in FIGS. 1–3 the orientation of the well tool device relative to the kickover tool must be established accordingly in order to assure proper registry of the windows when the well tool device is installed in the mandrel's receptacle.

It should also be understood that while the indexing means was herein presented as opposed recesses and/or holes in the running tool and the well tool device, other kinds of orienting means could be readily provided. For instance, a pin on one of the members could engage a selected one of many recesses or holes formed in the other member, or a spring-loaded detent on one of the members could engage splines formed on the other member, or a gear on one member could mesh with a gear on the other member.

It should be further understood that by orienting a flow control device in a side pocket mandrel so that a large window in the wall of the device is in register with a large window in the wall of the mandrel's receptacle bore provides a fluid flow path which is less restricting and less tortuous. Both of these features serve to greatly reduce damages to the device and the mandrel due to flow cutting or errosion by fluids flowing therethroughz especially those carrying abrasive particles.

Thus, it has been shown that the embodiments illustrated and described herein above fulfill all of the objects set out earlier; that a well tool device can be installed in the offset receptacle of a side pocket mandrel in oriented relation therein; and that making such an installation requires that the side pocket mandrel and the kickover tool have means coengageable to orient the kickover tool with respect to the mandrel and its offset receptacle, and that the well tool device must be carried by the kickover tool in such oriented position relative thereto that when the device is installed in the offset receptacle, it will be situated in the desired and predetermined oriented relation therein.

The foregoing description is herein presented by way of explanation only and changes in the materials, arrangement of parts or elements or the sizes thereof, as well as variations in the methods and equipment may be had within the scope of the appended claims without departing from the true spirit of this invention.

We claim:

1. Apparatus for installing a well tool device in the offset receptacle of a side pocket mandrel in predetermined oriented relation therewith, said mandrel having means therein for orienting a kickover tool, said apparatus comprising:

a. a kickover tool having well tool device carrying means thereon, said kickover tool having orienting means thereon cooperable with said orienting means in said side pocket mandrel for orienting said kickover tool relative to said offset receptacle of said side pocket mandrel;

b. a well tool device carried on said well tool device carrying means of said kickover tool;

c. means for releasably attaching said well tool device to said well tool device carrying means; and d. means separate from said attaching means for orienting said well tool device with respect to said well tool device carrying means.

2. The apparatus of claim 1, wherein said means for orienting said well tool device with respect to said well tool device carrying means is a pin disposed in aligned recesses in said well tool device carrying means and said well tool device.

3. The apparatus of claim 1, wherein the means for orienting the well tool device with respect to said well tool device carrying means is frictional gripping means in said tool carrier means for frictionally gripping an exterior surface on said well tool device to hold it in oriented relation.

4. The apparatus of claim 3, wherein said means for gripping and holding said well tool device in oriented relation is a resilient ring carried in an internal recess in said tool carrier means and is frictionally engageable with the exterior surface of said device.

5. The apparatus of claim 1, wherein said means for orienting said well tool device with respect to said well tool device carrying means comprises coengageable indexing means on said well tool device carrying means and said well tool device.

6. The apparatus of claim 5, wherein said indexing means includes:

a. circumferentially spaced indexing recesses on one of said well tool device carrying means and said well tool device;

b. circumferentially spaced indexing recesses on the other of said well tool device carrying means and said well tool device, said indexing recesses on said well tool device carrying means and said well tool device being disposed in opposing relation; and c. key means engageable between a selected pair of said opposing indexing recesses to orient said device with respect to said well tool device carrying means.

7. The apparatus of claim 6, wherein the recesses on one of said well tool carrier means and said well tool device are downwardly opening holes extending in a longitudinal direction and said key means is insertable in a selected one of said holes and having its outer end engageable in a selected one of said indexing recesses in the other of said well tool carrier means and said well tool device to hold said device in predetermined oriented relation with respect to said tool carrier means.

8. A kickover tool for installing a well tool in the offset receptacle of a side pocket mandrel, said side pocket mandrel being of the orienting type having orienting sleeve means therein, comprising:

a. an elongate body connectable to a tool string;

b. orienting key means on said body engageable with said orienting sleeve means in said side pocket mandrel for orienting said kickover tool in said side pocket mandrel relative to said offset receptacle;

c. a pivot arm pivoted to said body at one of its ends and having a well tool carrier means at its opposite end, said pivot arm being initially in longitudinal alignment with said body and pivotable to a non-aligned position to place said well tool carrier means above and in substantial axial alignment with said offset receptacle;

d. means for releasably attaching a well tool to said well tool carrier means; and e. means separate from said attaching means for orienting said well tool in predetermined oriented position with respect to said well tool carrier means.

9. The kickover tool of claim 8, wherein said means for maintaining said well tool oriented relative to said well tool carrier means is a resilient ring carried on said carrier means and frictionally engaging the exterior surface of said well tool to hold said well tool against rotational movement relative to said well tool carrier means.

10. The kickover tool of claim 8, wherein said means for orienting said well tool relative to said well tool carrier means is a spacer of predetermined thickness disposed between opposing shoulders of a threaded connection.

11. The kickover tool of claim 8, wherein said means for orienting said well tool relative to said carrier means is indexing means, comprising:

a. a plurality of circumferentially spaced downwardly opening indexing recesses on said carrier means, b. a plurality of circumferentially spaced upwardly opening indexing recesses on said well tool, and c. key means engageable in a selected pair of aligned opposed recesses to prevent relative rotation between the well tool and the well tool carrier means.

12. The kickover tool of claim 11, wherein the indexing means provides a number of indexing positions for the well tool, this number of positions equaling the product of the number of downwardly facing recesses multiplied by the number of upwardly facing recesses.

13. The kickover tool of claim 8, wherein said means for orienting said well tool device in predetermined oriented position with respect to said well tool carrier means is a screw locking a threaded connection.

14. In combination, an orienting running tool and latch device for use with an orienting kickover tool for installing a device in the offset receptacle of a side pocket mandrel in predetermined oriented relation therewith, comprising:

a. a running tool having a body attachable to a kickover tool and having a bore opening downwardly adapted to receive the upper end portion of said latch device;

b. means providing a plurality of circumferentially spaced downwardly opening recesses in said body;

c. a latch device having a body having an upper end portion adapted to be received in the bore of said running tool;

d. means providing a plurality of circumferentially upwardly opening recesses on said latch body; and e. key means engageable in a selected pair of aligned recesses of said running tool and said latch to hold said latch in selected oriented relation with said running tool.

15. The combination of claim 14, wherein the number of said recesses on one of said running tool and said latch is unequal to the number of recesses on the other said running tool and latch device.

16. The combination of claim 15, wherein said key means is a pin having one of its ends engageable in a selected recess of said running tool and other end engageable in a selected recess of said latch.

17. The combination of claim 16, wherein said recesses of said running tool are downwardly opening blind holes and said pin is frictionally engageable therein whereby said pin will be retrieved from said side pocket mandrel with said running tool.

18. Apparatus for installing a well tool in the offset receptacle of a side pocket mandrel in predetermined oriented relation therewith, comprising:

a. a side pocket mandrel connectable in a well flow conductor, said mandrel having;

i. a main bore therethrough, ii. an offset receptacle bore alongside said main bore, iii. a lateral window through the wall of said mandrel, and iv. orienting sleeve means in said mandrel;

b. a kickover tool movable into said mandrel, said kickover tool having:

i. means thereon cooperating with said orienting sleeve means of said mandrel for orienting said kickover tool relative to said receptacle bore, and ii. well tool carrier means for attaching a well tool to said kickover tool;

c. a well tool carried by said well tool carrier means to be installed in the offset recepatacle bore of said mandrel, said well tool having a downwardly opening bore and a lateral window in its wall communicating the exterior thereof with its interior.

d. means for releasably attaching said well tool to said well tool carrier means; and e. means separate from said attaching means for orienting said well tool with respect to said well tool carrier means.

19. A method of installing a well tool device in the offset receptacle of a side pocket mandrel in a well using a kickover tool, the well having a tubing string with at least one side pocket mandrel therein and each said side pocket mandrel having orienting sleeve means therein, comprising the steps of:

a. providing means on said kickover tool and said well tool device for releasably attaching them together;

b. providing means on said kickover tool and said well tool device separate from said attaching means for orienting said well tool device with respect to said kickover tool;

c. attaching said well tool device to said kickover tool in predetermined oriented relation therewith, said kickover tool being provided with orienting key means;

d. lowering the kickover tool in the well flow conductor to a location at least as deep as the side pocket mandrel in which the well tool device is to be installed;

e. manipulating the kickover tool to engage its orienting key means with the orienting sleeve means of the side pocket mandrel to orient the kickover tool about its longitudinal axis with respect to the offset receptacle of the side pocket mandrel;

f. actuating the kickover tool to kickover position to shift the well tool device laterally to a position above and in substantial longitudinal alignment with said offset receptacle;

g. inserting and anchoring said well tool device in said offset receptacle, and h. withdrawing said kickover tool from said well, leaving said well tool device installed in said offset receptacle in predetermined oriented relation.

20. The method of claim 19, wherein indexing means is provided for orienting said well tool with respect to said kickover tool.

21. The method of claim 20, wherein said indexing means includes:

a. a plurality of circumferentially spaced downwardly opening recesses on said kickover tool, b. a plurality of circumferentially spaced upwardly opening recesses on said well tool opposing said recesses on said kickover tool, and c. key means engaged in an aligned pair of opposed recesses preventing relative rotation between said well tool and said kickover tool.

22. The method of claim 19, wherein said means for holding said well tool in predetermined oriented relation with said kickover tool includes a resilient ring for frictionally engaging an exterior surface of the well tool.

23. The method of claim 19, wherein said side pocket mandrel is provided with a lateral window communicating its exterior with said offset receptacle and said well tool device is provided with a tubular body having a lateral window in its wall communicating its exterior with its interior, and said windows are in register with each other, and said method includes the further step of transmitting sound waves between the exterior and the interior of said well tubing through said registered windows.

24. The method of claim 23, wherein said tubular body of said well tool device is provided with an open lower end.

* * * * *